US008221590B2

(12) United States Patent
Ruf et al.

(10) Patent No.: US 8,221,590 B2
(45) Date of Patent: Jul. 17, 2012

(54) HEADBOX FOR A MACHINE FOR PRODUCING A FIBROUS WEB

(75) Inventors: Wolfgang Ruf, Herbrechtingen (DE); Konstantin Ferkl, Heldenfingen (DE); Markus Iläussler, Herbrechtingen (DE); Klaus Lehleiter, Steinheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/151,036

(22) Filed: Jun. 1, 2011

(65) Prior Publication Data

US 2011/0290441 A1 Dec. 1, 2011

Related U.S. Application Data

(63) Continuation of application No. PCT/EP2009/063837, filed on Oct. 22, 2009.

(30) Foreign Application Priority Data

Dec. 18, 2008 (DE) ..... 10 2008 054 898

(51) Int. Cl.
*D21F 1/18* (2006.01)

(52) U.S. Cl. ..... 162/341

(58) Field of Classification Search ..... 162/341
See application file for complete search history.

(56) References Cited

FOREIGN PATENT DOCUMENTS

| | | | |
|---|---|---|---|
| DE | 44 16 898 | A1 | 11/1995 |
| DE | 44 16 899 | A1 | 11/1995 |
| DE | 44 16 909 | A1 | 11/1995 |
| DE | 199 26 805 | A1 | 12/2000 |
| DE | 102 45 154 | A1 | 4/2004 |
| DE | 10 2008 043 145 | A1 | 4/2010 |
| DE | 10 2008 054 898 | A1 | 6/2010 |
| EP | 0 629 739 | A1 | 12/1994 |
| EP | 0683266 | A1 | 11/1995 |
| EP | 0 824 157 | A2 | 2/1998 |
| EP | 0 629 739 | B1 | 9/1999 |
| EP | 2 199 459 | A1 | 6/2010 |

OTHER PUBLICATIONS

PCT/EP2009/063837 International Search Report dated Jan. 22, 2010. (2 pages).

International Search Report dated Jan. 22, 2010 for PCT/EP2009/063837 (2 pages).

(Continued)

*Primary Examiner* — Mark Halpern
(74) *Attorney, Agent, or Firm* — Taylor IP, P.C.

(57) ABSTRACT

The invention relates to a headbox for a machine for producing a fibrous web, especially a paper or cardboard web, from at least one fiber suspension, comprising a feed device feeding the at least one fiber suspension, a perforated distribution pipe plate arranged immediately downstream thereof and having a plurality of channels arranged in lines and columns, an intermediate channel arranged downstream thereof, extending over the width of the headbox and having a plurality of means for dosing a fluid in partial fluid streams to the at least one fiber suspension in a preferably adjustable/controlled manner, the means being spaced apart from each other in the width direction of the headbox and the individual means comprising a plurality of dosing channels having respective dosing channel openings on the outlet side and a dosing channel length, arriving at different levels and being connected to a common supply channel. The headbox according to the invention is characterized in that the dosing channel length of the dosing channel is 1.5 times longer than the dosing channel opening of the dosing channel on the outlet side and in that the distance of the dosing channel opening of the dosing channel on the outlet side to the turbulence generator ranges from 0 to 50 mm.

37 Claims, 4 Drawing Sheets

OTHER PUBLICATIONS

English translation of International Preliminary Report on Patentability dated Jun. 21, 2011 for PCT/EP2009/063837 (7 pages).

English translation of Written Opinion of the International Searching Authority (undated) for PCT/EP2009/063837 (6 pages), Jun. 2011.

International Search Report dated Jan. 22, 2010 for PCT/EP2009/063838 (2 pages).

English translation of International Preliminary Report on Patentability dated Jun. 21, 2011 for PCT/EP2009/063838 (8 pages).

English translation of Written Opinion of the International Searching Authority (undated) for PCT/EP2009/063838 (7 pages).

International Search Report dated Jan. 22, 2010 for PCT/EP2009/063846 (2 pages).

English translation of International Preliminary Report on Patentability dated Jun. 21, 2011 for PCT/EP2009/063846 (7 pages).

English translation of Written Opinion of the International Searching Authority (undated) for PCT/EP2009/063846 (6 pages).

HEADBOX FOR A MACHINE FOR PRODUCING A FIBROUS WEB

CROSS REFERENCE TO RELATED APPLICATIONS

This is a continuation of PCT application No. PCT/EP2009/063837, entitled "HEADBOX FOR A MACHINE FOR PRODUCING A FIBROUS WEB", filed Oct. 22, 2009, which is incorporated herein by reference.

BACKGROUND OF THE INVENTION

1. Field of the Invention

The invention relates to a headbox for a machine for producing a fibrous web, in particular a paper or cardboard web from at least one fibrous stock suspension, comprising a feed device feeding the at least one fibrous stock suspension, a perforated distribution pipe plate arranged immediately downstream thereof and having a plurality of channels arranged in rows and columns, an intermediate channel arranged downstream thereof, extending over the width of the headbox and having a plurality of means for dosing of a fluid in partial fluid streams to the at least one fibrous stock suspension in a preferably adjustable/controllable manner, the means being spaced apart from each other in width direction of the headbox and the individual means comprising a plurality of dosing channels having respective dosing channel openings on the outlet side and a dosing channel length, discharging at different levels and being connected to a common supply channel. The headbox further comprises a downstream turbulence generator having a plurality of flow channels arranged in rows and columns and a headbox nozzle comprising a nozzle gap, located immediately adjacent to the turbulence generator.

2. Description of the Related Art

A headbox of this type is known for example from German disclosure documents DE44 16 898 A1, DE 44 16 899 A1 and DE 44 16 909 A1.

German disclosure document DE 44 16 898 A1 describes a headbox for a paper machine; including a feed device for the stock suspension comprising a guiding element with a plurality of channels; upstream from a guiding element a mixing chamber with several infeed devices which are distributed over the headbox for a fluid which is to be added to the stock suspension and which differs in its characteristics from the stock suspension; and with a nozzle chamber forming an outlet opening for the stock suspension, located immediately downstream from the guiding element. The feed devices for the fluid which is to be added extend essentially vertically in the mixing chamber and comprise several dosing openings located on top of each other.

German disclosure document DE 44 16 899 A1 describes a headbox for a paper machine including a feed device for the stock suspension, with a first guiding element comprising a plurality of channels, a second guiding element comprising a plurality of channels, an intermediate mixing chamber, a contiguous nozzle chamber forming an outlet opening for the stock suspension, and several feed lines distributed over the headbox for the fluid which is to be added. The majority of the channels of the guiding elements are positioned and dimensioned so that the outlet opening of the upstream guiding element is not aligned with a confluence into the downstream guiding element. The feed lines for the fluid which is to be added are equipped with dosing openings, the majority of which align respectively with a confluence into the downstream guiding element.

In addition, German disclosure document DE 44 16 909 A1 describes a headbox for a paper machine with a feed device for the stock suspension, a downstream contiguous guiding element equipped with a plurality of channels, located downstream from there a downstream mixing chamber extending across the width of the headbox with several separation walls distributed across the headbox and extending essentially in flow direction, as well as feed devices for a fluid which is to be added, distributed in cross direction of the headbox and which are equipped with dosing openings, downstream an additional guiding element equipped with a plurality of channels and adjacent to it, one nozzle chamber forming an outlet opening for the stock suspension.

The feed devices for the fluid which is to be added extend into the mixing chamber and the sectional area which is formed in the mixing chamber by the separation walls begins in the region of the dosing openings from where it extends essentially in flow direction to the second guiding element.

The headboxes described in these three documents provide systems which are able to fulfill especially the technological requirements regarding good blending quality of fibrous stock suspension and fluid, sufficient volume stream consistency, low effective width and a low mapping offset more or less well, or only partially. The blending quality of fibrous stock suspension and fluid is usually positively influenced by good pre-distribution of the mediums in height direction, by high turbulence intensity in the mediums and by a long distance over which blending of the mediums occurs. A low dynamic at the dosing location and a high pressure value after the dosing location are favorable for volume flow consistency. An adjusted and steadied flow before the dosing location, light cross flows at the dosing location and only a short, or preferably no intermediate channel after the dosing location, a synchronous separation of dosing location and turbulence generator and a targeted locally stable dosing into the turbulence generator are important for the desired small effective width. Generally the same criterion applies for the mapping offset requirements as for the effective width requirements. However, there is the additional criterion of a good volume flow constancy and slight cross compensation in the headbox.

It is therefore the objective of the current invention, and what is needed in the art is, to improve a headbox of the type described at the beginning, so that the known disadvantages of the state of the art are significantly, preferably completely eliminated and that a substantial improvement in meeting especially the technological requirements is achieved. In addition, a technically simple and reliable dosing system is to be cited which can be implemented in an economical and technically simple manner.

SUMMARY OF THE INVENTION

This objective is met with, and the present invention provides, a headbox of the type described at the beginning in that the dosing channel length of the dosing channel is 1.5·(times) longer than the dosing channel opening of the dosing channel on the outlet side and that the distance of the dosing channel opening of the dosing channel on the outlet side to the turbulence generator, especially to an inlet plate of the turbulence generator is in a range of 0 to 50 mm, preferably 0 to 30 mm, especially 10 to 25 mm.

The inventive objective is completely met in this manner.

The inventive design of the headbox of the type described at the beginning provides a significant, preferably complete elimination of the disadvantages of the current state of the art and a substantially improved fulfillment especially of the technological requirements. The inventive headbox comprises moreover a technically simple and reliable dosing system which, in addition is also economically and technically simple to implement.

Especially the discussed arrangement of the dosing channels over the height and the dimensioning of the respective dosing channel have a very positive effect on the required good to very good blending quality of fibrous stock suspension and fluid, the required low effective width and the necessary low mapping offset.

In addition at least one separation element which is well known to the expert, in particular a lamella may be provided in the headbox nozzle of the inventive headbox. In the event that several separating elements, in particular lamellas are arranged in the headbox nozzle of the inventive headbox they may have different lengths and possibly different properties such as surface profiles.

The means, especially in the embodiment of a dosing sword for preferably adjustable/controllable dosing of fluid in partial fluid streams into the at least one fibrous stock suspension is located preferably at the lower wall and/or at the upper wall of the intermediate channel. This design is especially advantageous with high row turbulence generators in order to limit the fluid inflow speeds in the individual fluid supply lines. Hereby the two walls of the intermediate channel may, at least in some areas be parallel, convergent, divergent, stepped or spherically curved toward each other. Also, locating the means for preferably adjustable/controllable dosing is possible in at least one row. If the means for preferably adjustable/controllable dosing are arranged in several rows, then they can be offset to each other.

Furthermore, the means for preferably adjustable/controllable dosing, especially in the embodiment of a dosing sword can consist of a metal, for example a special steel, titanium or bronze, or a synthetic material, for example a duroplastic, a thermoplastic, a (hard) rubber, a GFK (glass fiber reinforced plastic), a CFK (carbon fiber reinforced plastic) or similar material. In the case of synthetic materials polyamide (PA), polyphenylene sulphone (PPSU), Teflon (PTFE), polyoxymethylene (POM) are advantageous.

The common supply channel of the means for preferably adjustable/controllable dosing can have a circular cross sectional surface with a diameter of 6 to 20 mm, preferably 10 to 15 mm and the dosing channel which is connected with the common supply channel of the means for preferably adjustable/controllable dosing can also have a circular cross sectional surface with a diameter of 2 to 10 mm, preferably 4 to 6 mm. Furthermore, the common supply channel as well as the dosing channel, viewed in respective longitudinal direction can have a constant, a continuously convergent or a rapidly expanding channel cross section. The dosing channels of the means for preferably adjustable/controllable dosing discharging at the same height can be arranged at uniform or approximately uniform distances from each other.

In addition the means for preferably adjustable/controllable dosing can have a preferably uniform or approximately uniform spacing in width direction of the headbox in the range of 10 to 100 mm, preferably of 25, 33, 50 or 66 mm and the means itself for adjustable/controllable dosing can have a length in the range of 60 to 350 mm, preferably 100 to 250 mm, and a height in the range of 50 to 300 mm, preferably 75 to 250 mm depending on the height of the intermediate channel.

The length of the means in the embodiment of dosing sword for preferably adjustable/controllable dosing of the fluid in partial fluid streams into the at least one fibrous stock suspension which is oriented in flow direction of the at least one fibrous stock suspension and the length of the intermediate channel are preferably in a ratio of 1:1.25 to 1:5, preferably 1:1.5 to 1:3, especially approximately 1:2. These value ranges especially affect the desired small effective width due to an adjusted and steadied flow before the dosing location and light cross flows at the dosing location.

In addition, the means in the embodiment of a dosing sword for preferably adjustable/controllable dosing of the fluid in partial fluid streams into the at least one fibrous stock suspension has a leading edge facing preferably in opposite direction to the flow direction of the at least one fibrous stock suspension which has an angle of less than 60 to 90°, preferably 75 to 85°, especially 80° in flow direction of the at least one fibrous stock suspension. This design offers flow technological advantages and, due to a "vertical component" can possibly remove soil particles adhering to the leading edge in direction of the free middle end. Also, the leading edge of the means in the embodiment of a dosing sword for preferably adjustable/controllable dosing of the fluid in partial fluid streams into the at least one fibrous stock suspension can have a face surface having a width of at least 3 mm, preferably at least 5 mm, especially approximately 10 mm and/or can be equipped at least on one side, preferably on both sides with a side curvature or chamfer. This side curvature can have a value in the range of 0.1 to 0.45, preferably 0.33, especially 0.25· of the width. In contrast, the chamfer can have a chamfer angle in the range of 25 to 75°, preferably 30 to 60°, especially 45°.

Furthermore, the means in the embodiment of a dosing sword for preferably adjustable/controllable dosing of the fluid in partial fluid streams into the at least one fibrous stock suspension is tapered, preferably at least in the area of its outlet side in flow direction of the at least one fibrous stock suspension, at least on one side, preferably on both sides, wherein the preferably continuous taper can have a taper angle of maximum 20°, preferably maximum 10°, especially maximum 7°. This design provides that, based on avoiding separation eddies on the outlet side area of the means for preferably adjustable/controllable dosing, the flow after the means for preferably adjustable/controllable dosing can be substantially steadied.

The width of the means in the embodiment of a dosing sword for preferably adjustable/controllable dosing of the fluid in partial fluid streams into the at least one fibrous stock suspension and the spacing of two flow channels, arranged in two adjacently located columns of the turbulence generator are preferably in a ratio of 1:5 to 1:1.25, preferably 1:3 to 1:15, especially approximately 1:1.65. The width of the means in the embodiment of dosing sword for preferably adjustable/controllable dosing can hereby assume a value in the range of 20 to 50 mm.

The means in the embodiment of a dosing sword for preferably adjustable/controllable dosing of the fluid in partial fluid streams into the at least one fibrous stock suspension is advantageously equipped with at least one recess, at least on one side, preferably on both sides in the area between dosing channel openings on the outlet side on dosing channels located adjacent to each other in longitudinal direction. This design permits realization of a short distance between the means for preferably adjustable/controllable dosing and the turbulence generator located downstream which again, is advantageous for the desired small effective width.

The dosing openings of the dosing channels of the means in the embodiment of a dosing sword for preferably adjustable/controllable dosing of the fluid in partial fluid streams into the at least one fibrous stock suspension can, on the one hand, all discharge at different heights or they can discharge in pairs at the same or approximately same heights and thereby have an opening angle between the opening center lines in the range of −30 to +30°, preferably 0 to 30°, especially 10 to 30°.

The point of impingement of the dosing opening centerline of the individual dosing opening onto the turbulence generator can be approximately centric, preferably in the center between the column planes of two adjacent flow channels or approximately aligned, preferably aligned with the flow channel center line of the flow channel of the turbulence generator. Also, an offset in height of the dosing opening center lines of the dosing openings relative to the flow channel center lines of the flow channels of the turbulence generator is possible, at least in some areas.

In regard to a compact construction of the headbox it is also advantageous if the perforated distribution pipe plate and the intermediate channel have a total length of approximately 500 mm, preferably 350 mm maximum, especially 300 mm maximum.

Under flow technical aspects, the feed device and the channels of the perforated distribution pipe plate are preferably dimensioned so that the flow speed of the at least one fibrous stock suspension in the feed device and the medium flow speed of the at least one fibrous stock suspension in the channels of the perforated distribution pipe plate is in a ratio of 1:2 to 1:3.

In addition, the respective channel of the perforated distribution pipe plate can have a constant, a continuously convergent, or a channel cross section expanding rapidly at least once, viewed in flow direction.

The individual channel of the perforated distributor pipe plate has preferably a round channel cross section with a channel diameter and the middle channel diameter of the individual channel of the perforated distributor pipe plate, and the length of the perforated distributor pipe plate are ideally in a ratio of 1:2 to 1:10, preferably 1:3 to 1:8, especially 1:4 to 1:5. These value ranges provide improved operating stability of the headbox in a possibly expanded operational window.

The fluid consists preferably of water, especially clarified water or of a fibrous stock suspension, especially white water whose concentration is different than the average concentration of the at least one fibrous stock suspension in the headbox. These types of fluids have already proven themselves well in similar applications.

The inventive headbox is extremely well suited for utilization in a machine for the production of a fibrous web, especially a paper or cardboard web. The fibrous web produced in the machine with at least one inventive headbox possesses outstanding properties throughout, since among other advantages, control of its fiber orientation cross profile as well as its base weight cross profile is possible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
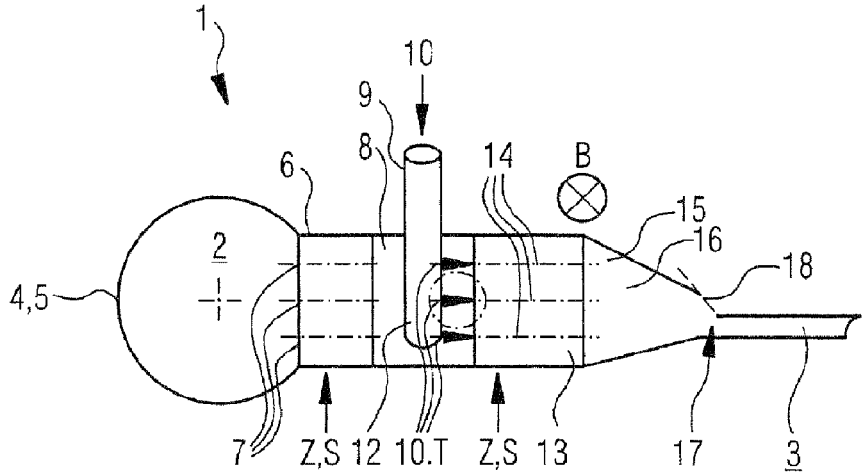
FIG. 1 is a vertical and schematic longitudinal sectional view of one inventive design form of a headbox for a machine for the production of a fibrous web from at least one fibrous stock suspension.

FIG. 1 shows a vertical and schematic longitudinal sectional view of one exemplary design form of a headbox 1 for a machine for producing a fibrous web 3 from a fibrous stock suspension 2. Illustrated headbox 1 can obviously also be designed as a multi-layer headbox utilizing at least two different fibrous stock suspensions to produce fibrous web 3. Fibrous web 3 can in particular be a paper, cardboard or tissue web.

Headbox 1 comprises one feed device 4 supplying the one fibrous stock suspension 2 in the embodiment, for example of an illustrated cross distribution pipe 5 or a circular distributor having a plurality of tubes and which is not illustrated.

Perforated distribution pipe plate 6 which is equipped with a plurality of channels 7 which are arranged in rows Z and columns S is located downstream adjacent to feed device 4.

Again located adjacent downstream from perforated distribution pipe plate 6 is an intermediate channel 8, extending across width B (arrow) of headbox 1 which is equipped with several means 9 for preferably adjustable/controllable dosing of a fluid 10 (arrow) in partial fluid streams 10.T (arrows) into fibrous stock suspension 2, the means being spaced apart from each other in width direction of headbox 1. The individual means 9 for the preferably adjustable/controllable dosing respectively comprises several dosing channels 11 having a respective dosing channel length 11.L and outlet-side dosing channel opening 11.1, discharging at different levels and being connected to a common supply channel 12 (Compare FIG. 2).

A turbulence generator 13 having a plurality of flow channels 14 arranged in rows Z and column S is located downstream from intermediate channel 8. During operation of headbox 1 the fibrous stock suspension 2 is divided into partial fibrous streams in turbulence generator 13 and, after emerging from the turbulence generator is brought together again in a machine-wide chamber 15 in the embodiment of a headbox nozzle 16 comprising a nozzle gap 17 in order to enable formation of a machine-wide fibrous web 3. As already known, flow channels 14 are in the embodiment of preferably thin-walled turbulence pipes and/or turbulence pipe inserts with at least partially constant, at least partially divergent, at least partially convergent and/or stepped cross sectional surfaces. A separating element which is well known to the expert and which is not explicitly illustrated, especially a lamella, may also be provided in headbox nozzle 16. If a multitude of separating elements, especially lamellas are provided in headbox nozzle 16, they can have different lengths and possibly also different properties, such as surface profiles, etc.

On its outlet side headbox nozzle 16 may be equipped with an aperture 18, at least on one side, which is indicated by broken lines.

Figure 2:
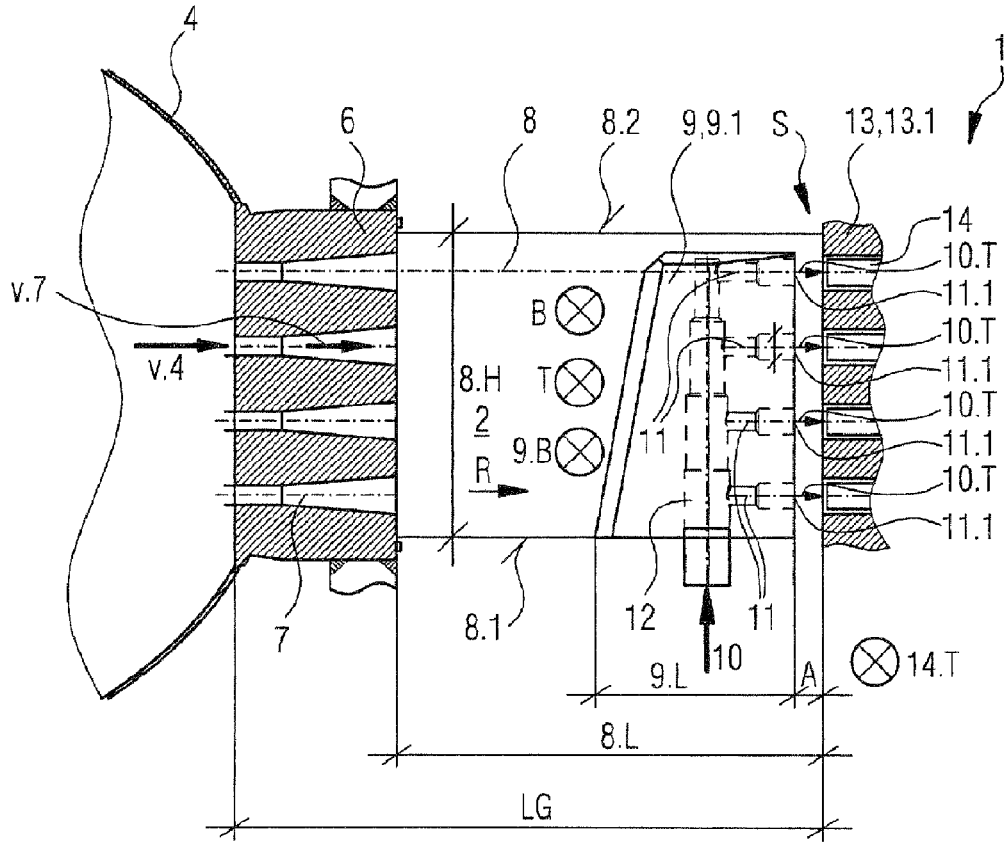
FIG. 2 is a partial and exemplary schematic detailed view of the headbox illustrated in FIG. 1.

FIG. 2 shows only a partial detailed depiction of headbox 1 which is illustrated schematically in FIG. 1.

Means 9 in the embodiment of dosing sword 9.1 for preferably adjustable/controllable dosing of a fluid 10 (arrow) in partial fluid streams 10.T (arrows) into fibrous stock suspension 2 comprises a plurality of dosing channels 11 having a respective dosing channel length 11.L and outlet-side dosing channel opening 11.1, discharging at different heights and being connected to a common supply channel 12. Herein all dosing openings 11.1 of dosing channels 11 of means 9 in the embodiment of dosing sword 9.1 for preferably adjustable/controllable dosing of fluid 10 (arrow) in partial fluid streams 10.T (arrow) into fibrous stock suspension 2 discharge at different heights.

Dosing channel length 11.L of individual dosing channel 11 is 1.5· longer than the dosing channel opening 11.1 of the same dosing channel 11 on the outlet side and distance A from the outlet-side dosing channel opening 11.1 of the same dosing channel 11 to turbulence generator 13, especially to an inlet plate 13.1 of turbulence generator 13 is in a range of 0 to 50 mm, preferably 0 to 30 mm, especially 10 to 25 mm.

Length 9.L of means 9 in the embodiment of dosing sword 9.1 for preferably adjustable/controllable dosing of fluid 10 (arrow) in partial fluid streams 10.T (arrows) into the at least one fibrous stock suspension 2 which is oriented in flow direction R (arrow) of the at least one fibrous stock suspension 2 and length 8.L of intermediate channel 8 are in a ratio of 1:1.25 to 1:5, preferably 1:1.5 to 1:3, especially approximately 1:2.

Width 9.B (arrow) of means 9 in the embodiment of dosing sword 9.1 for preferably adjustable/controllable dosing of fluid 10 (arrow) in partial fluid streams 10.T (arrows) into fibrous stock suspension 2 and the spacing 14.T (arrow) of two flow channels 14, arranged in two adjacently located columns S of turbulence generator 13 are in a ratio of 1:5 to 1:1.25, preferably 1:3 to 1:15, especially approximately 1:1.65. The width 9.B (arrow) of means 9 in the embodiment of dosing sword 9.1 for preferably adjustable/controllable dosing can hereby assume a value in the range of 20 to 50 mm.

Means 9 for preferably adjustable/controllable dosing have a preferably uniform or approximately uniform spacing T (arrow) in width direction of headbox 1 in the range of 10 to 100 mm, preferably of 25, 33, 50 or 66 mm.

In addition, means 9 in the embodiment of a dosing sword 9.1 for preferably adjustable/controllable dosing of fluid 10 in partial fluid streams 10.T (arrow) into the at least one fibrous stock suspension 2 is located at the lower wall 8.1 of intermediate channel 8. Alternatively or in addition means 9 for preferably adjustable/controllable dosing can also be located at upper wall 8.2 of intermediate channel 8. In the current example the two walls 8.1, 8.2 of intermediate channel 8 are arranged parallel to each other; they may however, at least in some areas be arranged parallel, convergent, divergent or spherically curved toward each other. Moreover, means 9 for preferably adjustable/controllable dosing are arranged in one row; they can however also be located in at least two rows, whereby they can moreover be offset to each other.

Perforated distribution pipe plate 6 and intermediate channel 8 have a total length LG of maximum 500 mm, preferably 350 mm maximum, especially 300 mm maximum.

Feed device 4 and channels 7 of perforated distribution pipe plate 6 are dimensioned so that flow speed v.4 (arrow) of fibrous stock suspension 2 in feed device 4 and flow speed v.7 of fibrous stock suspension 2 in channels 7 of perforated distribution pipe plate 6 are in a ratio of 1:2 to 1:3.

Figure 3:
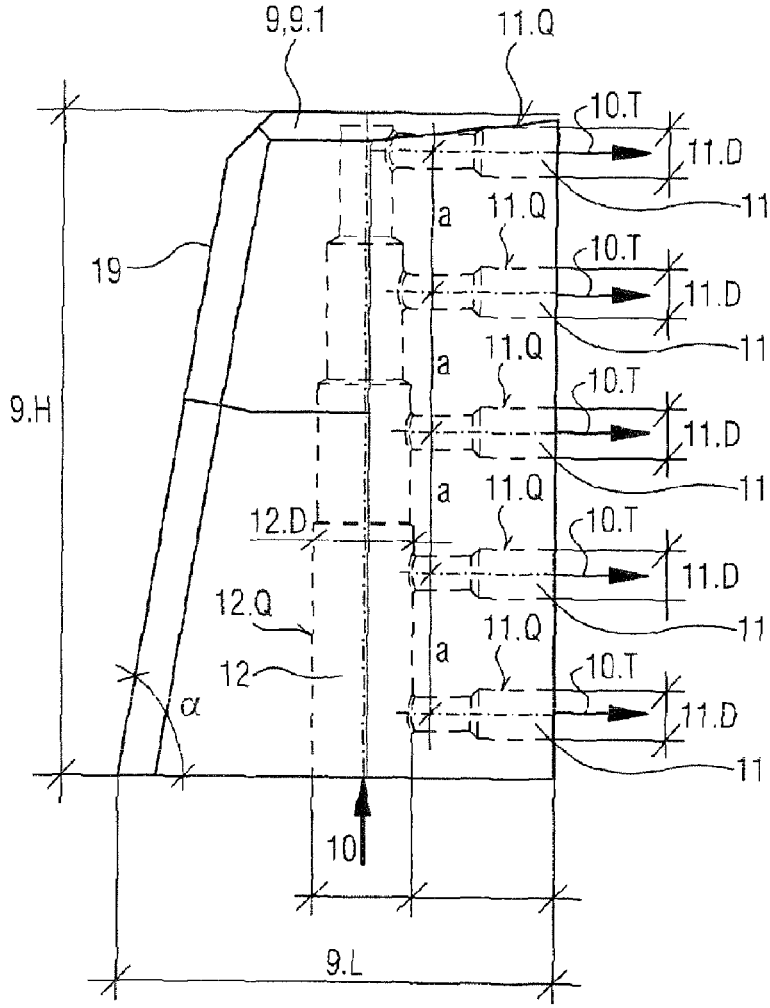
FIG. 3 is a schematic detailed view of the means for preferably adjustable/controllable dosing of fluid in partial fluid streams, illustrated schematically in FIG. 2.

FIG. 3 shows a schematic detailed view of means 9 for preferably adjustable/controllable dosing of fluid 10 (arrow) in partial fluid streams 10.T (arrows) illustrated in FIG. 2.

All dosing channels 11 of means 9 in the embodiment of dosing sword 9.1 for preferably adjustable/controllable dosing discharging at different heights are located at equal or approximately equal distances a and have a circular cross sectional surface 11.Q with a diameter 11.D of 2 to 10 mm, preferably 4 to 6 mm. In contrast, common supply channel 12 of means 9 for preferably adjustable/controllable dosing has a circular cross sectional surface 12.Q with a diameter 12.D of 6 to 20 mm, preferably 10 to 15 mm. Common supply channel 12 as well as individual dosing channel 11—viewed in respective longitudinal direction—has a constant, a continuously convergent or a rapidly expanding channel cross section 12.Q, 11.Q. Means 9 for preferably adjustable/controllable dosing has a length 9.L in the range of 60 to 350 mm, preferably 100 to 250 mm, and a height 9.H in the range of 50 to 300 mm, preferably 75 to 250 mm, whereby height 9.H is selected depending on the clearance height 8.H of intermediate channel 8 (compare FIG. 2). This leaves a gap of ≧3 mm, preferably ≧5 mm between means 9 in the embodiment of dosing sword 9.1 for preferably adjustable/controllable dosing and the adjacent wall of intermediate channel 8 (compare FIG. 2).

Means 9 in the embodiment of dosing sword 9.1 for preferably adjustable/controllable dosing of the fluid 10 (arrow) in partial fluid streams 10.T (arrows) into fibrous stock suspension 1 has a leading edge 19 facing preferably in opposite direction to flow direction R (arrow) of fibrous stock suspension 2 which has an angle $\alpha$ of less than 60 to 90°, preferably 75 to 85°, especially 80° in flow direction R (arrow) of fibrous stock suspension 2.

Figure 4:
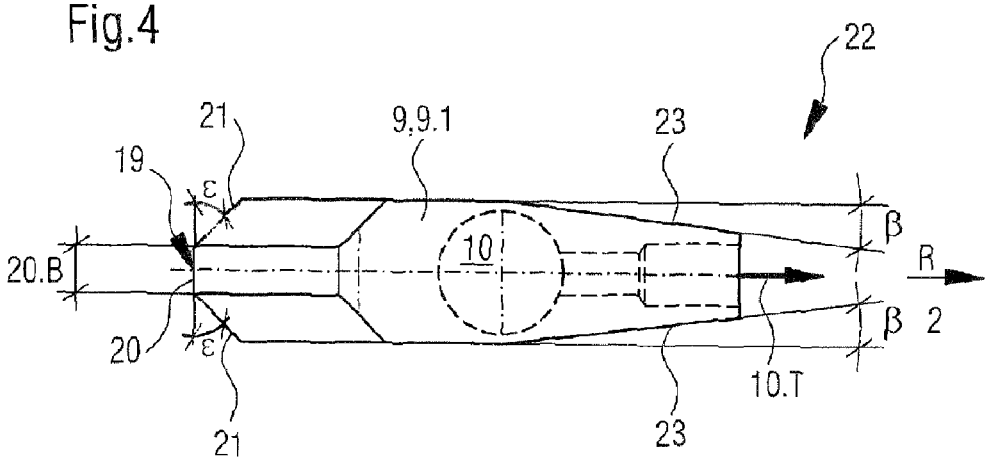
FIG. 4 is a view of the means for preferably adjustable/controllable dosing of fluid in partial fluid streams, illustrated schematically in FIG. 3.

FIG. 4 is a view of means 9 for preferably adjustable/controllable dosing of fluid 10 in partial fluid streams 10.T (arrow), illustrated in FIG. 3.

Leading edge 19 of means 9 in the embodiment of a dosing sword 9.1 for preferably adjustable/controllable dosing of fluid 10 in partial fluid streams 10.T (arrow) into fibrous stock suspension 2 has a face surface 20 having a width 20.B of at least 3 mm, preferably at least 5 mm, especially approximately 10 mm. Also, leading edge 19 of means 9 for preferably adjustable/controllable dosing is equipped on both sides with a side chamfer 21. This chamfer 21 can have a chamfer angle in the range of 25 to 75°, preferably 30 to 60°, especially 45°.

Means 9 for preferably adjustable/controllable dosing is tapered in flow direction R (arrow) of fibrous stock suspension 2, on both sides, wherein the preferably continuous taper 23 has a taper angle $\beta$ of 20° maximum, preferably 10° maximum, especially 7° maximum.

Figure 5:
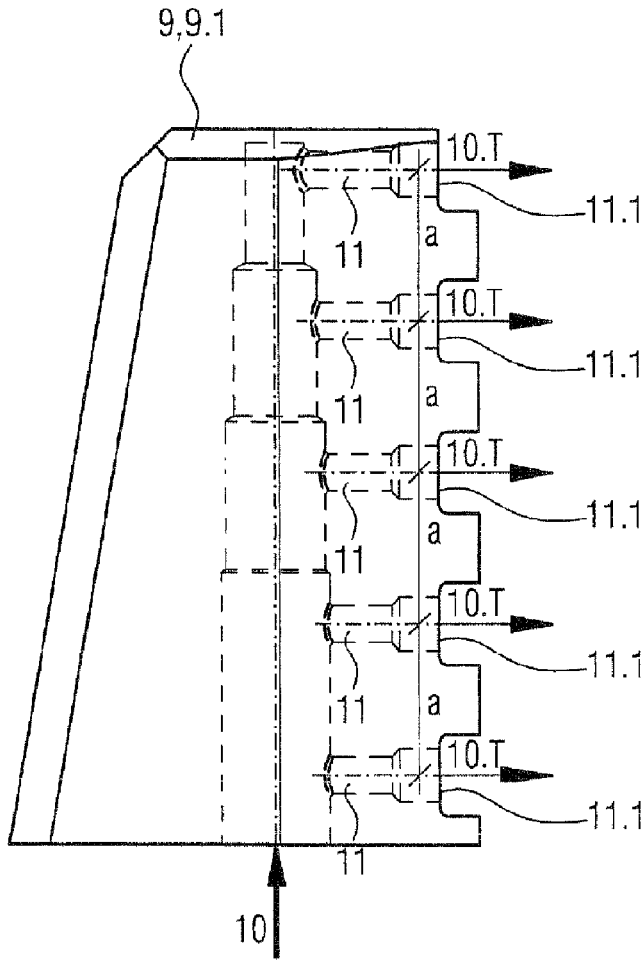
FIG. 5 is a schematic detailed view of an additional design form of the means for preferably adjustable/controllable dosing of fluid in partial fluid streams.

FIG. 5 shows a schematic detailed view of an additional design form of means 9 for preferably adjustable/controllable dosing of fluid 10 (arrow) in partial fluid streams 10.T (arrows). The basic construction of this means 9 for preferably adjustable/controllable dosing is substantially consistent with the basic construction of means 9 for preferably adjustable/controllable dosing illustrated schematically in FIG. 3. We therefore refer to the description provided for that drawing.

Figure 6:
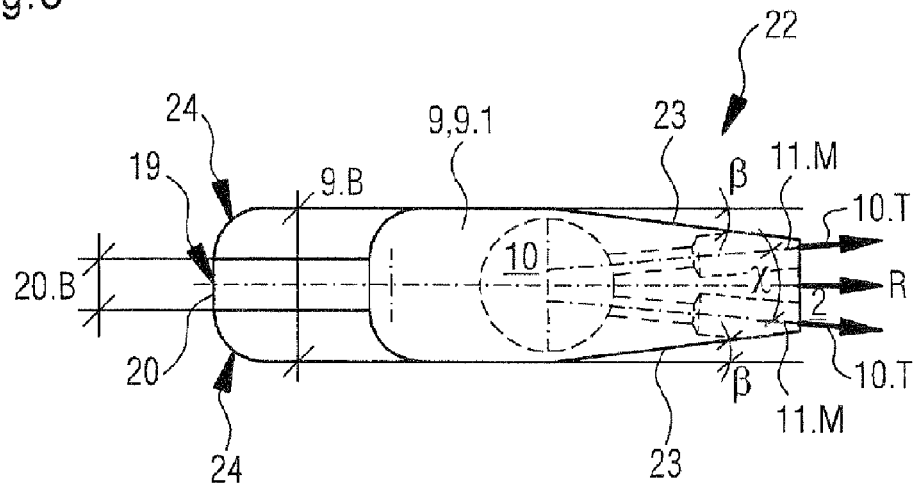
FIG. 6 is a view of the means for preferably adjustable/controllable dosing of fluid in partial fluid streams illustrated schematically in FIG. 5.

Dosing openings 11.1 of dosing channels 11 of means 9 in the embodiment of a dosing sword 9.1 for preferably adjustable/controllable dosing of fluid 10 (arrow) in partial fluid streams 10.T (arrows) into fibrous stock suspension 2 discharge at the same or approximately same heights and have an opening angle x between the opening center lines 11.M in the range of −30 to +30°, preferably 0 to 30°, especially 10 to 30° (compare FIG. 6).

Dosing channels 11 of means 9 in the embodiment of dosing sword 9.1 for preferably adjustable/controllable dosing of fluid 10 (arrow) in partial fluid streams 10.T (arrows) into fibrous stock suspension 2 which are arranged in pairs are located at equal or approximately equal distances a.

FIG. 6 illustrates one view of the means 9 for preferably adjustable/controllable dosing of fluid 10 in partial fluid streams 10.T (arrows), illustrated in FIG. 5.

Leading edge 19 of means 9 in the embodiment of a dosing sword 9.1 for preferably adjustable/controllable dosing of the fluid 10 in partial fluid streams 10.T (arrow) into fibrous stock suspension 2 has a face surface 20 having a width 20.B of at least 3 mm, preferably at least 5 mm, especially approximately 10 mm. Leading edge 19 for preferably adjustable/controllable dosing is equipped on both sides with a side curvature 24. Side curvature 24 can have a value in the range of 0.1 to 0.45, preferably 0.33, especially 0.25· of width 9.B of means 9 in the embodiment of dosing sword 9.1.

Means 9 for preferably adjustable/controllable dosing is tapered in its outlet area 22 on both sides, in flow direction R (arrow) of fibrous stock suspension 2, whereby the preferably continuous taper 23 has a taper angle β of 20° maximum, preferably 10° maximum, especially 7° maximum.

Figure 7:
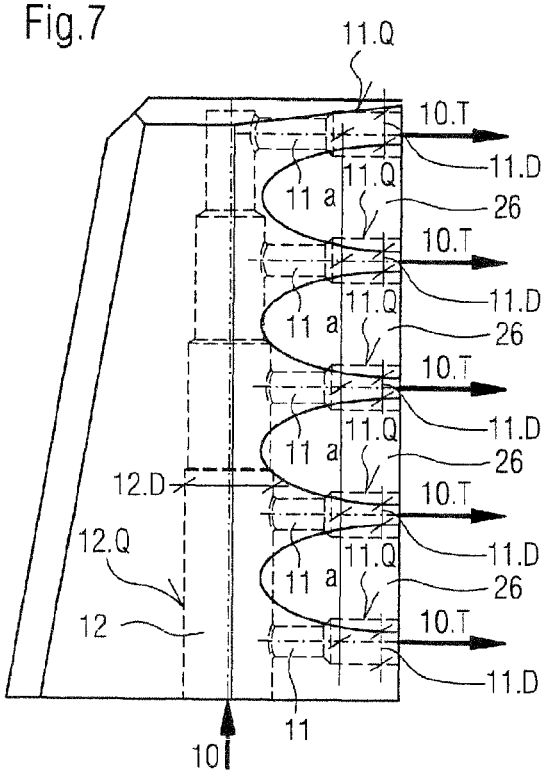
FIG. 7 is a schematic detailed view of a third design form of the means for preferably adjustable/controllable dosing of fluid in partial fluid streams.

FIG. 7 is a schematic detailed view of a third design form of means 9 for preferably adjustable/controllable dosing of fluid 10 (arrow) in partial fluid streams 10.T (arrows). The basic construction of this means 9 for preferably adjustable/controllable dosing is substantially consistent with the basic construction of means 9 for preferably adjustable/controllable dosing illustrated in FIG. 3. We therefore refer to the description provided for that drawing.

All dosing channels 11 of means 9 in the embodiment of dosing sword 9.1 for preferably adjustable/controllable dosing of fluid 10 (arrow) in partial fluid streams 10.T (arrows) into fibrous stock suspension 2 discharging at different heights are located at equal or approximately equal distances a and have a circular cross sectional surface 11.Q with a diameter 11.D of 2 to 10 mm, preferably 4 to 6 mm. In contrast, common supply channel 12 of means 9 for preferably adjustable/controllable dosing has a circular cross sectional surface 12.Q with a diameter 12.D of 6 to 20 mm, preferably 10 to 15 mm.

In addition, means 9 in the embodiment of dosing sword 9.1 for preferably adjustable/controllable dosing is equipped with at least one recess 26 on both sides in the area 25.1, 25.2 (compare FIG. 8) between two dosing channel openings 11.1 on the outlet side on dosing channels 11 located adjacent to each other in longitudinal direction.

Figure 8:
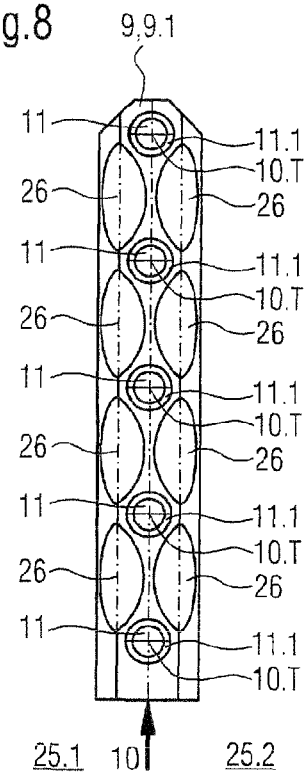
FIG. 8 is a view of the means for preferably adjustable/controllable dosing of fluid in partial fluid streams illustrated schematically in FIG. 8.

FIG. 8 is a view of means 9 for preferably adjustable/controllable dosing of fluid 10 in partial fluid streams 10.T (arrows) illustrated schematically in FIG. 7.

Here, recesses 26 provided between two outlet-side dosing channel openings 11.1 of dosing channels 11 located adjacent to each other in longitudinal direction of means 9 in the embodiment of dosing sword 9.1 for preferably adjustable/controllable dosing can be clearly seen.

Figure 9:
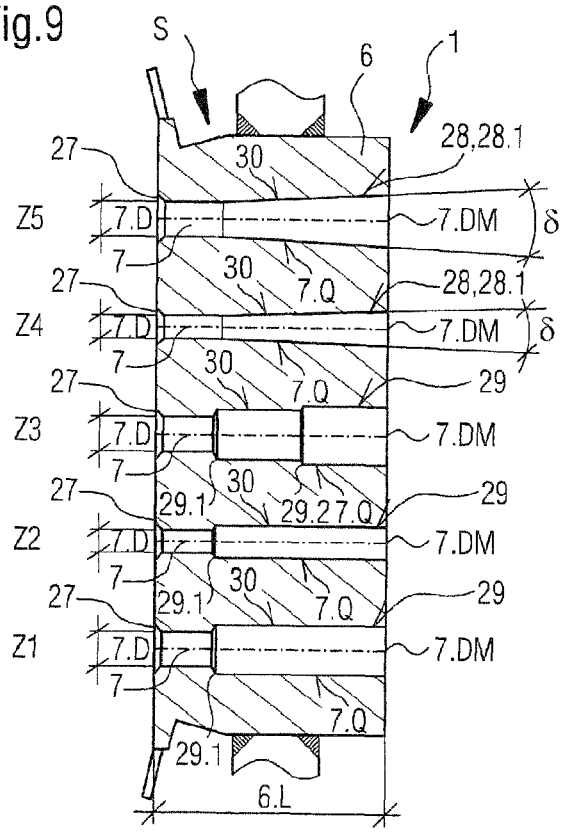
FIG. 9 is a vertical and schematic longitudinal sectional view of a perforated distribution pipe plate of the inventive headbox for a machine to produce a fibrous web from at least one fibrous stock suspension and having different channel cross sections.

FIG. 9 provides a vertical and schematic longitudinal sectional view of a perforated distribution pipe plate 6 of the inventive headbox 1 for a machine to produce a fibrous web from at least one fibrous stock suspension, comprising five channels 7 with different channel cross sections 7.Q.

Perforated distribution pipe plate 6 has five rows Z1 to Z5 of channels 7 and a multitude of columns S of channels 7. All channels 7 have a round channel cross section 7.Q, however in different forms and embodiments. All channels 7 are also provided on the inlet side with an inlet chamfer, known to the expert.

Channels 7 of the two upper rows Z4, Z5 initially have a constant channel cross section 7.Q which lastly experiences a continuous expansion 28, especially a cone 28.1 with a cone angle δ of ≦30°.

Channels 7 of middle row Z3 have again initially a constant channel cross section 7.Q which later experience two rapid expansions 29, especially step expansions 29.1, 29.2.

Channels 7 of the two lower rows Z1, Z2 have again initially a constant channel cross section 7.Q which lastly experience only one rapid expansion 29, especially one step expansion 29.1.

Each individual channel 7 of perforated distribution pipe plate 6 therefore initially has a round channel cross section 7.Q with a channel diameter 7.D and lastly forms at least one diffuser 30 based on at least one of the expansions 28, 29. The middle channel diameter 7.DM of channel 7 of perforated distribution pipe plate 6 and length 6.L of perforated distribution pipe plate 6 have a ratio of 1:2 to 1:10, preferably 1:3 to 1:8, especially 1:4 to 1:5.

The characteristics of the design forms of headbox 1 described in FIGS. 1 through 9 can also be combined with each other, at least partially in a manner well known to the expert. Also, means 9 for preferably adjustable/controllable dosing in the embodiment of dosing sword 9.1 can consist at least of one metal, for example a special steel, titanium or bronze, or a synthetic material, for example a duroplastic, a thermoplastic, a (hard) rubber, a GFK (glass fiber reinforced plastic), a CFK (carbon fiber reinforced plastic) or similar material. In the case of synthetic materials polyamide (PA), polyphenylene sulphone (PPSU), Teflon (PTFE), polyoxymethylene (POM) are particularly advantageous.

Fluid 10 flowing through respective headbox 1 illustrated in FIGS. 1 through 4 consists at least of water, especially white water or clarified water or of at least one fibrous stock suspension whose concentration is different than the average concentration of the at least one fibrous stock suspension 2 flowing through headbox 1.

Headbox 1 illustrated and described in the drawings is especially well suited for utilization in a machine to produce a fibrous web 3, in particular a paper or cardboard web from at least one fibrous stock suspension 2.

In summary it must be stated that the current invention improves a headbox of the type described at the beginning, so that the known disadvantages of the state of the art are significantly, preferably completely eliminated and that a substantial improvement in meeting especially the technological requirements is achieved. The inventive headbox moreover comprises a technically simple and reliable dosing system which, moreover, can be implemented in an economical and technically simple manner.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

| Component Identification | |
|---|---|
| 1 | Headbox |
| 2 | Fibrous stock suspension |
| 3 | Fibrous web |
| 4 | Feed device |
| 5 | Cross distribution pipe |
| 6 | Perforated distribution pipe plate |
| 7 | Channel |
| 7.D | Channel diameter |
| 7.DM | Middle channel diameter |
| 7.Q | Channel cross section |
| 8 | Intermediate channel |
| 8.1 | Lower wall |
| 8.2 | Upper wall |
| 8.H | Height |
| 8.L | Length |
| 9 | Means for preferably adjustable/controllable dosing of a fluid |
| 9.1 | Dosing sword |
| 9.B | Width (arrow) |
| 9.H | Height |
| 9.L | Length |
| 10 | Fluid (arrow) |
| 10.T | Partial fluid stream (arrow) |
| 11 | Dosing channel |
| 11.1 | Dosing channel opening |
| 11.D | Diameter |
| 11.L | Dosing channel length |
| 11.M | Opening center line |
| 11.Q | Cross sectional surface |
| 12 | Supply channel |
| 12.D | Diameter |
| 12.Q | Cross sectional surface |
| 13 | Turbulence generator |
| 13.1 | Inlet plate |
| 14 | Flow channel |
| 14.T | Separation (arrow) |
| 15 | Machine-wide chamber |
| 16 | Headbox nozzle |
| 17 | Nozzle gap |
| 18 | Aperture |
| 19 | Leading edge |
| 20 | Face surface |
| 20.B | Width |
| 21 | Chamfer |
| 22 | Outlet side area |
| 23 | Taper |
| 24 | Curvature |
| 25.1 | Area on one side |
| 25.1 | Area on one side |
| 26 | Recess |
| 27 | Inlet chamfer |
| 28 | Continuous expansion |
| 28.1 | Cone |
| 29 | Rapid expansion |
| 29.1 | Step expansion |
| 29.2 | Step expansion |
| 30 | Diffuser |
| A | Distance |
| B | Width (arrow) |
| LG | Total length |
| R | Flow direction (arrow) |
| S | Column |
| T | Spacing |
| v.4 | Flow speed (arrow) |
| v.7 | Flow speed (arrow) |
| Z | Row |
| Z1 | Row |
| Z2 | Row |
| Z3 | Row |

-continued

| Component Identification | |
|---|---|
| Z4 | Row |
| Z5 | Row |
| α | Angle |
| β | Taper angle |
| χ | Opening angle |
| δ | Cone angle |
| ϵ | Chamfer angle |

What is claimed is:

1. A headbox for a machine for producing a web of fibrous material from at least one fibrous stock suspension, the web being one of a paper web and a cardboard web, said headbox comprising:

a feed device feeding the at least one fibrous stock suspension;

a perforated distribution pipe plate arranged immediately downstream from said feed device and having a plurality of channels arranged in a plurality of rows and a plurality of columns;

an intermediate channel arranged downstream from said perforated distribution pipe plate, extending over a width of the headbox, and having a plurality of devices for dosing of a fluid in a plurality of partial fluid streams to the at least one fibrous stock suspension in at least one of an adjustable and a controllable manner, said intermediate channel including a common supply channel, said plurality of devices being spaced apart from each other in a width direction of the headbox, said plurality of devices individually including a plurality of dosing channels, said plurality of dosing channels respectively including an outlet side, a dosing channel opening on said outlet side, and a dosing channel length, said plurality of dosing channels discharging at different levels and being connected to said common supply channel, said dosing channel length of each of said plurality of dosing channels being 1.5 times longer than said dosing channel opening of said plurality of dosing channels on said outlet side;

a turbulence generator downstream from said intermediate channel and having a plurality of flow channels arranged in a plurality of rows and a plurality of columns, a distance from said dosing channel opening of each of said plurality of dosing channels on said outlet side to said turbulence generator being in a range of 0 to 50 mm; and a headbox nozzle including a nozzle gap, said headbox nozzle being located immediately adjacent to said turbulence generator.

2. The headbox according to claim 1, wherein said turbulence generator includes an inlet plate, said distance from said dosing channel opening of each of said plurality of dosing channels on said outlet side to said inlet of said turbulence generator being in a range of 0 to 50 mm.

3. The headbox according to claim 2, wherein said distance from said dosing channel opening of each of said plurality of dosing channels on said outlet side to said inlet of said turbulence generator is in a range of 0 to 30 mm.

4. The headbox according to claim 2, wherein said distance from said dosing channel opening of each of said plurality of dosing channels on said outlet side to said inlet of said turbulence generator is in a range of 10 to 25 mm.

5. The headbox according to claim 1, wherein said intermediate channel includes a lower wall and an upper wall, said plurality of devices, each being formed as a dosing sword, for at least one of adjustable and controllable dosing of said fluid in said plurality of partial fluid streams into the at least one fibrous stock suspension being located at at least one of said lower wall and said upper wall of said intermediate channel.

6. The headbox according to claim 1, wherein a length of each of said plurality of devices, each being formed as a dosing sword, for at least one of adjustable and controllable dosing of said fluid in said plurality of partial fluid streams into the at least one fibrous stock suspension which is oriented in a flow direction of the at least one fibrous stock suspension and a length of said intermediate channel are in a ratio of 1:1.25 to 1:5.

7. The headbox according to claim 1, wherein a length of each of said plurality of devices, each being formed as a dosing sword, for at least one of adjustable and controllable dosing of said fluid in said plurality of partial fluid streams into the at least one fibrous stock suspension which is oriented in a flow direction of the at least one fibrous stock suspension and a length of said intermediate channel are in a ratio of 1:1.5 to 1:3.

8. The headbox according to claim 1, wherein a length of each of said plurality of devices, each being formed as a dosing sword, for at least one of adjustable and controllable dosing of said fluid in said plurality of partial fluid streams into the at least one fibrous stock suspension which is oriented in a flow direction of the at least one fibrous stock suspension and a length of said intermediate channel are in a ratio of approximately 1:2.

9. The headbox according to claim 1, wherein each of said plurality of devices, each being formed as a dosing sword, for at least one of adjustable and controllable dosing of said fluid in said plurality of partial fluid streams into the at least one fibrous stock suspension has a leading edge facing in an opposite direction to a flow direction of the at least one fibrous stock suspension which has an angle of less than 60° to 90° in said flow direction of the at least one fibrous stock suspension.

10. The headbox according to claim 1, wherein each of said plurality of devices, each being formed as a dosing sword, for at least one of adjustable and controllable dosing of said fluid in said plurality of partial fluid streams into the at least one fibrous stock suspension has a leading edge facing in an opposite direction to a flow direction of the at least one fibrous stock suspension which has an angle of 75° to 85° in said flow direction of the at least one fibrous stock suspension.

11. The headbox according to claim 1, wherein each of said plurality of devices, each being formed as a dosing sword, for at least one of adjustable and controllable dosing of said fluid in said plurality of partial fluid streams into the at least one fibrous stock suspension has a leading edge facing in an opposite direction to a flow direction of the at least one fibrous stock suspension which has an angle of 80° in said flow direction of the at least one fibrous stock suspension.

12. The headbox according to claim 11, wherein said leading edge of each of said plurality of devices, each formed as said dosing sword, for at least one of adjustable and controllable dosing of said fluid in said plurality of partial fluid streams into the at least one fibrous stock suspension has a face surface having a width of at least 3 mm.

13. The headbox according to claim 11, wherein said leading edge of each of said plurality of devices, each formed as said dosing sword, for at least one of adjustable and controllable dosing of said fluid in said plurality of partial fluid streams into the at least one fibrous stock suspension has a face surface having a width of at least 5 mm.

14. The headbox according to claim 11, wherein said leading edge of each of said plurality of devices, each formed as said dosing sword, for at least one of adjustable and controllable dosing of said fluid in said plurality of partial fluid streams into the at least one fibrous stock suspension has a face surface having a width of approximately 10 mm.

15. The headbox according to claim 11, wherein said leading edge of each of said plurality of devices, each formed as said dosing sword, for at least one of adjustable and controllable dosing of said fluid in said plurality of partial fluid streams into the at least one fibrous stock suspension is equipped at least on one side with one of a side curvature and a chamfer.

16. The headbox according to claim 11, wherein said leading edge of each of said plurality of devices, each formed as said dosing sword, for at least one of adjustable and controllable dosing of said fluid in said plurality of partial fluid streams into the at least one fibrous stock suspension is equipped on both sides with one of a side curvature and a chamfer.

17. The headbox according to claim 1, wherein each of said plurality of devices, each formed as a dosing sword, for at least one of adjustable and controllable dosing of said fluid in said plurality of partial fluid streams into the at least one fibrous stock suspension is tapered at least in an area of said outlet side of each of said plurality of devices in a flow direction of the at least one fibrous stock suspension at least on one side so as to form a continuous taper.

18. The headbox according to claim 1, wherein each of said plurality of devices, each formed as a dosing sword, for at least one of adjustable and controllable dosing of said fluid in said plurality of partial fluid streams into the at least one fibrous stock suspension is tapered at least in an area of said outlet side of each of said plurality of devices in a flow direction of the at least one fibrous stock suspension on both sides so as to form a continuous taper, said continuous taper having a taper angle of 20° maximum.

19. The headbox according to claim 1, wherein each of said plurality of devices, each formed as a dosing sword, for at least one of adjustable and controllable dosing of said fluid in said plurality of partial fluid streams into the at least one fibrous stock suspension is tapered at least in an area of said outlet side of each of said plurality of devices in a flow direction of the at least one fibrous stock suspension on both sides so as to form a continuous taper, said continuous taper having a taper angle of 10° maximum.

20. The headbox according to claim 1, wherein each of said plurality of devices, each formed as a dosing sword, for at least one of adjustable and controllable dosing of said fluid in said plurality of partial fluid streams into the at least one fibrous stock suspension is tapered at least in an area of said outlet side of each of said plurality of devices in a flow direction of the at least one fibrous stock suspension on both sides so as to form a continuous taper, said continuous taper having a taper angle of 7° maximum.

21. The headbox according to claim 1, wherein a width of each of said plurality of devices, each formed as a dosing sword, for at least one of adjustable and controllable dosing of said fluid in said plurality of partial fluid streams into the at least one fibrous stock suspension and a spacing of two of said plurality of flow channels arranged in two adjacently located ones of said plurality of columns of said turbulence generator are in a ratio of 1:5 to 1:1.25.

22. The headbox according to claim 1, wherein a width of each of said plurality of devices, each formed as a dosing sword, for at least one of adjustable and controllable dosing of said fluid in said plurality of partial fluid streams into the at least one fibrous stock suspension and a spacing of two of said plurality of flow channels arranged in two adjacently located ones of said plurality of columns of said turbulence generator are in a ratio of 1:3 to 1:15.

23. The headbox according to claim 1, wherein a width of each of said plurality of devices, each formed as a dosing sword, for at least one of adjustable and controllable dosing of said fluid in said plurality of partial fluid streams into the at least one fibrous stock suspension and a spacing of two of said plurality of flow channels arranged in two adjacently located ones of said plurality of columns of said turbulence generator are in a ratio of approximately 1:1.65.

24. The headbox according to claim 1, wherein said plurality of devices, each formed as a dosing sword, for at least one of adjustable and controllable dosing of said fluid in said plurality of partial fluid streams into the at least one fibrous stock suspension is equipped with at least one recess at least on one side in an area between respective ones of said dosing channel opening on said outlet side on said plurality of dosing channels located adjacent to each other in a longitudinal direction.

25. The headbox according to claim 1, wherein said plurality of devices, each formed as a dosing sword, for at least one of adjustable and controllable dosing of said fluid in said plurality of partial fluid streams into the at least one fibrous stock suspension is equipped with at least one recess on both sides in an area between respective ones of said dosing channel opening on said outlet side on said plurality of dosing channels located adjacent to each other in a longitudinal direction.

26. The headbox according to claim 1, wherein each said dosing channel opening of said plurality of dosing channels of said plurality of devices, each formed as a dosing sword, for at least one of adjustable and controllable dosing of said fluid in said plurality of partial fluid streams into the at least one fibrous stock suspension discharge at different heights.

27. The headbox according to claim 1, wherein respective ones of said dosing channel opening of said plurality of dosing channels of said plurality of devices, each formed as a dosing sword, for at least one of adjustable and controllable dosing of said fluid in said plurality of partial fluid streams into the at least one fibrous stock suspension discharge in a plurality of pairs at one of same and approximately same heights and have an opening angle between respective ones of a plurality of opening center lines in a range of −30° to +30°.

28. The headbox according to claim 1, wherein respective ones of said dosing channel opening of said plurality of dosing channels of said plurality of devices, each formed as a dosing sword, for at least one of adjustable and controllable dosing of said fluid in said plurality of partial fluid streams into the at least one fibrous stock suspension discharge in a plurality of pairs at one of same and approximately same heights and have an opening angle between respective ones of a plurality of opening center lines in a range of 0° to 30°.

29. The headbox according to claim 1, wherein respective ones of said dosing channel opening of said plurality of dosing channels of said plurality of devices, each formed as a dosing sword, for at least one of adjustable and controllable dosing of said fluid in said plurality of partial fluid streams into the at least one fibrous stock suspension discharge in a plurality of pairs at one of same and approximately same heights and have an opening angle between respective ones of a plurality of opening center lines in a range of 10° to 30°.

30. The headbox according to claim 1, wherein said perforated distribution pipe plate and said intermediate channel have a total length of 500 mm maximum.

31. The headbox according to claim 1, wherein said perforated distribution pipe plate and said intermediate channel have a total length of 350 mm maximum.

32. The headbox according to claim 1, wherein said perforated distribution pipe plate and said intermediate channel have a total length of 300 mm maximum.

33. The headbox according to claim 1, wherein said feed device and said plurality of channels of said perforated distribution pipe plate are dimensioned so that a flow speed of the at least one fibrous stock suspension in said feed device and a flow speed of the at least one fibrous stock suspension in said plurality of channels of said perforated distribution pipe plate are in a ratio of 1:2 to 1:3.

34. The headbox according to claim 1, wherein each of said plurality of channels of said perforated distribution pipe plate has a round channel cross section with a channel diameter and a middle channel diameter, said middle channel diameter and a length of said perforated distribution pipe plate being in a ratio of 1:2 to 1:10.

35. The headbox according to claim 1, wherein each of said plurality of channels of said perforated distribution pipe plate has a round channel cross section with a channel diameter and a middle channel diameter, said middle channel diameter and a length of said perforated distribution pipe plate being in a ratio of 1:3 to 1:8.

36. The headbox according to claim 1, wherein each of said plurality of channels of said perforated distribution pipe plate has a round channel cross section with a channel diameter and a middle channel diameter, said middle channel diameter and a length of said perforated distribution pipe plate being in a ratio of 1:4 to 1:5.

37. A machine for producing a web of fibrous material from at least one fibrous stock suspension, the web being one of a paper web and a cardboard web, said machine comprising:

at least one headbox including:

a feed device feeding the at least one fibrous stock suspension;

a perforated distribution pipe plate arranged immediately downstream from said feed device and having a plurality of channels arranged in a plurality of rows and a plurality of columns;

an intermediate channel arranged downstream from said perforated distribution pipe plate, extending over a width of said at least one headbox, and having a plurality of devices for dosing of a fluid in a plurality of partial fluid streams to the at least one fibrous stock suspension in at least one of an adjustable and a controllable manner, said intermediate channel including a common supply channel, said plurality of devices being spaced apart from each other in a width direction of said at least one headbox, said plurality of devices individually including a plurality of dosing channels, said plurality of dosing channels respectively including an outlet side, a dosing channel opening on said outlet side, and a dosing channel length, said plurality of dosing channels discharging at different levels and being connected to said common supply channel, said dosing channel length of each of said plurality of dosing channels being 1.5 times longer than said dosing channel opening of said plurality of dosing channels on said outlet side;

a turbulence generator downstream from said intermediate channel and having a plurality of flow channels arranged in a plurality of rows and a plurality of columns, a distance from said dosing channel opening of each of said plurality of dosing channels on said outlet side to said turbulence generator being in a range of 0 to 50 mm; and a headbox nozzle including a nozzle gap, said headbox nozzle being located immediately adjacent to said turbulence generator.

* * * * *